US011450986B2

(12) United States Patent
Lai

(10) Patent No.: US 11,450,986 B2
(45) Date of Patent: Sep. 20, 2022

(54) CONNECTOR WITH PRESSING MECHANISM

(71) Applicant: JESS-LINK PRODUCTS CO., LTD., New Taipei (TW)

(72) Inventor: Cheng-Chung Lai, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 17/367,797

(22) Filed: Jul. 6, 2021

(65) Prior Publication Data

US 2022/0190514 A1 Jun. 16, 2022

(30) Foreign Application Priority Data

Dec. 11, 2020 (TW) ..... 109143901

(51) Int. Cl.
*H01R 13/514* (2006.01)
*H01R 13/627* (2006.01)
*H01R 13/639* (2006.01)

(52) U.S. Cl.
CPC ..... *H01R 13/6273* (2013.01); *H01R 13/514* (2013.01); *H01R 13/639* (2013.01)

(58) Field of Classification Search
CPC ..... H01R 13/6273; H01R 13/514; H01R 13/502; H01R 13/639; H01R 13/6275; H01R 13/6335
See application file for complete search history.

(56) References Cited

U.S. PATENT DOCUMENTS 7,226,307 B1 * 6/2007 Chen ..... H01R 13/6275 439/352
7,476,117 B1 * 1/2009 Chen ..... H01R 13/6335 439/352

FOREIGN PATENT DOCUMENTS

CN 107634386 A * 1/2018 ..... H01R 12/515
CN 111326915 A * 6/2020 ..... H01R 12/716

* cited by examiner

*Primary Examiner* — Tho D Ta
(74) *Attorney, Agent, or Firm* — Chun-Ming Shih; HDLS IPR Services

(57) ABSTRACT

A connector with a pressing mechanism, and the connector includes a foundation, a latch mechanism, a release mechanism, and a cover. The foundation includes two position limiting parts and two accommodating spaces are arranged on two edges of the foundation. The latch mechanism includes a base arranged on the foundation, and the base includes a fixing part fixed in a fixing hole, and two latches are arranged in the accommodating spaces of two edges of the base. The release mechanism is assembled between the two position limiting parts, and the front end of a handle of the release mechanism is extended with a protruding part, and the bottom of the protruding part is a concave bottom. The cover is assembled on the foundation, and the cover includes an opening, and the pressing mechanism is located in the opening corresponding to the through hole and connected to the cover.

14 Claims, 9 Drawing Sheets

CONNECTOR WITH PRESSING MECHANISM

BACKGROUND

Technical Field

The present disclosure relates to a connector, and more particularly to a connector with a pressing mechanism.

Description of Related Art

The statements in this section merely provide background information related to the present disclosure and do not necessarily constitute prior art.

The connectors are commonly used to transmit signals or power, and the connectors are important between electrical products or machines. In the past, when the transmission line (or cable) was in use, the connector of the plug on the transmission line was plugged into the connector of the socket of the electrical product or machine. If the transmission line is accidentally pulled or dragged during the signal transmission, the connection between the plug on the transmission line and the socket on the electrical product may be released, and the signal transmission may be forced to terminate, or the data of the signal transmission may be damaged or lost.

In order to solve the aforementioned technical problems, it may be considered that the plug of the transmission line includes an anti-loosening latch (such as a barb) structure. When the plug is electrically connected to the socket of an electrical product, the latch structure of the plug hooks on the socket of the electrical product, so that the plug and the socket are not easily to be released, and the signal is transmitted stably. The plug of the connector may include a latch structure, some connectors have a release mechanism to unlock the latch structure, so that the connector of the plug and the socket is released smoothly. But the position of the release mechanism on some plugs is often blocked by adjacent connectors or other transmission lines or connectors with larger volumes, which makes it difficult for the release mechanism on the plug to be pressed, so that the connector of the plug and the socket may not be released out smoothly.

SUMMARY

In order to solve the aforementioned technical problems, the main purpose of the present disclosure is to redesign a mechanism for releasing and latching, so that a release mechanism on the connector is easily pressed or pulled to easily separate the plug and the socket of the connector.

In order to achieve the main purpose above-mentioned, the present disclosure provides a connector with a pressing mechanism, and the connector includes a foundation, a latch mechanism, a release mechanism, and a cover. The foundation, comprising a top surface, and a front side of the top surface comprising at least one assembly hole, and a rear side of the top surface comprising at least one fixing hole, wherein position limiting part is arranged between the assembly holes, and arranged between the fixing holes, and two accommodating spaces symmetrical to each other are respectively arranged on two edges of the top surface. The latch mechanism, assembled on the top surface, and comprising a base in a manner of an elastic sheet, wherein at least one fixing part fixed to the fixing hole is extended from a side edge of the base, two latches are respectively arranged on each of two edges of the base, and the two latches are perpendicular to the base and located in the accommodating spaces. The release mechanism, assembled between the two position limiting parts, and arranged above the latch mechanism, wherein the release mechanism comprises a handle, and a front end of the handle is extended with a protruding part, and the protruding part comprises a concave bottom, the concave bottom straddles over the base, and the concave bottom comprises an inclined surface corresponding to a side edge of the base, and the protruding part comprises a through hole. The cover, assembled on the foundation, and comprising an opening, and the pressing mechanism integrally connected with the cover and located in the opening corresponding to the through hole, wherein the cover comprises at least one buckling part and at least one fastening block, and the buckling part is assembled in the assembly hole, and the fastening block is fastened in the fixing hole to fasten the fixing part of the latch mechanism.

In some embodiments of the present disclosure, the accommodating space is in a manner of a slit.

In some embodiments of the present disclosure, the foundation comprises at least one bump in a manner of a barb respectively disposed on two sides thereof.

In some embodiments of the present disclosure, the cover comprises two lugs bent from two edges thereof and symmetrical to each other, and each lug comprises at least one engaging hole, and the engaging hole is engaged with the bump on each side of the foundation.

In some embodiments of the present disclosure, a blocking part is arranged on a front end of the protruding part, and the blocking part comprises a protruding wall disposed on one side thereof.

In some embodiments of the present disclosure, the cover comprises a front flange and a rear flange disposed on an inner surface thereof, the front flange and the rear flange respectively have a notch corresponding to each other, and the protruding wall and the handle on the front end of the blocking part of the release mechanism are positioned by the two notches, the protruding part of the release mechanism is located between the two notches.

In some embodiments of the present disclosure, the opening, the buckling part, and the fastening block are arranged between the front flange and the rear flange.

In some embodiments of the present disclosure, the pressing mechanism comprises an elastic sheet.

In some embodiments of the present disclosure, a cross section of the protruding part is of an arched shape or an inverted-U shape.

In some embodiments of the present disclosure, the fixing part comprises a rod part, and the rod part comprises a fastening piece bent from one end thereof, and the fastening piece is perpendicular to the rod part, and the fastening piece is assembled in the fixing hole.

In some embodiments of the present disclosure, each of the two latches comprises an arm part, and the arm part comprises a hook part disposed on a front end thereof to hook on a main connector.

In some embodiments of the present disclosure, the foundation comprises at least one tongue disposed inside, and the tongue is extended outside the foundation and comprises a plurality of conductive terminals disposed thereon, and the conductive terminals are electrically connected with a cable.

In some embodiments of the present disclosure, the cover comprises two perforations respectively disposed on two edges thereof, and the two perforations are symmetrical to each other, and the two latches pass through the two perforations respectively.

In some embodiments of the present disclosure, the latch mechanism is made of a metal material.

DETAILED DESCRIPTION

The technical content and detailed description of the present disclosure are now described with the drawings as follows.

Figure 1:
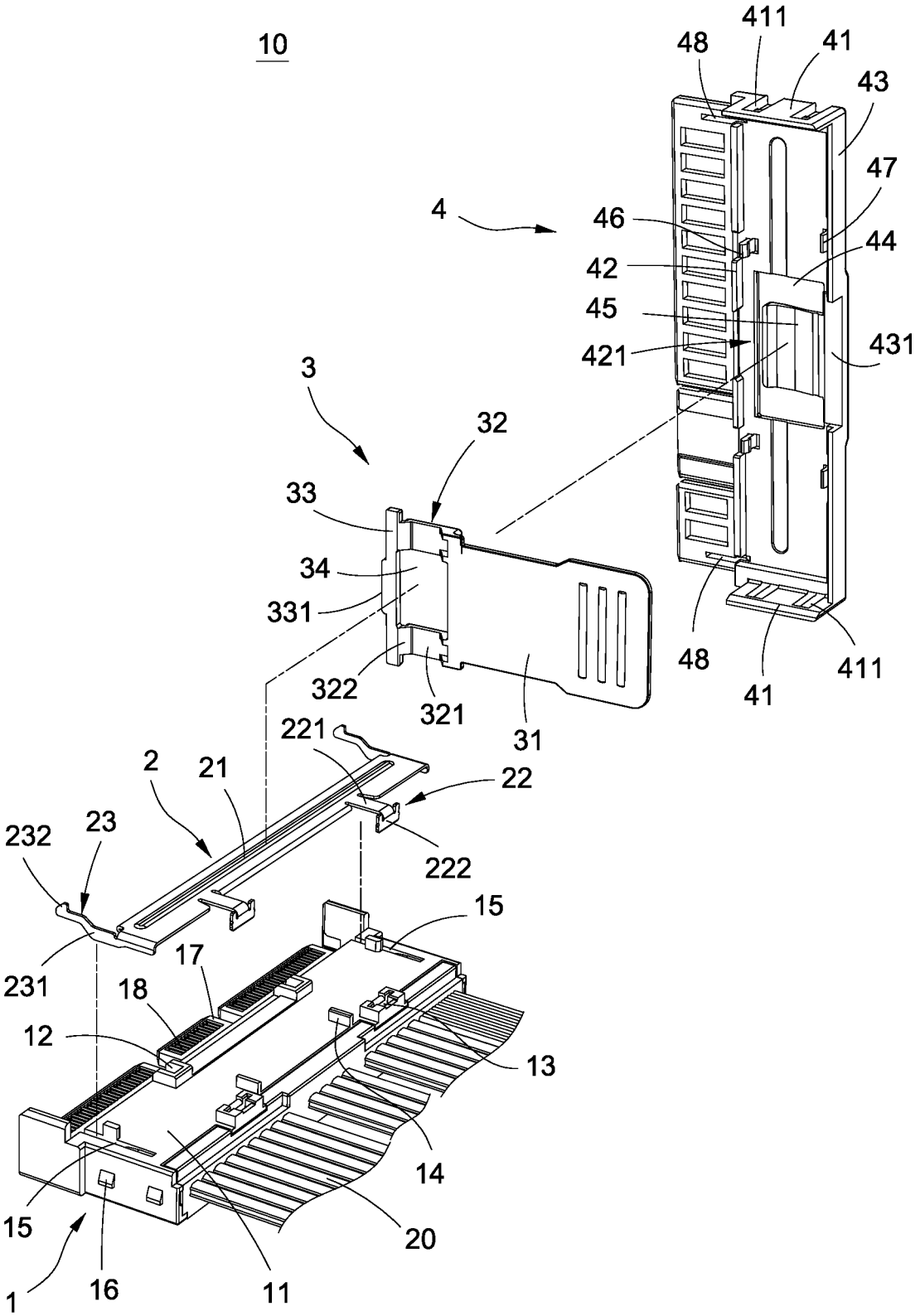
FIG. 1 is an exploded schematic diagram of a connector of the present disclosure.

Please refer to FIG. 1. A connector with a pressing mechanism of the present disclosure, and the connector 10 includes a foundation 1, a latch mechanism 2, a release mechanism 3, and a cover 4. The cover 4 has a pressing mechanism 45, and the pressing mechanism 45 and the release mechanism 3 form a dual function structure for releasing the latch mechanism 2 or locking with a main connector (or female connector, not shown). After the latch mechanism 2 is released by one of the pressing mechanism 45 or the release mechanism 3, the connector 10 may be pulled out smoothly from the main connector.

The foundation 1 includes a top surface 11, and the front side of the top surface 11 includes at least one of assembly hole 12. Here uses, but not limited to, two assembly holes 12 as an example. The assembly holes 12 are used for assembling the cover 4. The rear side of the top surface 11 includes at least one of fixing holes 13. Here uses, but not limited to, two fixing holes 13 as an example. The fixing holes 13 are used for positioning the latch mechanism 2. Two position limiting parts 14 are arranged between the assembly holes 12 and the fixing holes 13, the two position limiting parts 14 are used for limiting the release mechanism 3 to be located between the two position limiting parts 14. Further, two accommodating spaces 15 that are symmetrical to each other are arranged on two edges of the top surface 11. the accommodating spaces 15 are in a manner of a slit for accommodating the two latches 23 of the latch mechanism 2, and the accommodating spaces 15 provides a space for the two latches 23 to sink and move. Further, each side of the foundation 1 includes at least one of bumps 16 in a manner of a barb, and the bumps 16 are used to hook the two lugs 41 of the cover 4. In addition, the foundation 1 includes at least one tongue 17, and the tongue 17 is extended outside the foundation 1. The disposed tongue 17 includes a plurality of conductive terminals (gold finger) 18 thereon. The plurality of conductive terminals 18 are electrically connected with a cable 20 for transmitting signals.

The latch mechanism 2 is assembled on the top surface 11 of the foundation 1. The latch mechanism 2 includes a base 21 in a manner of an elastic sheet. At least one of fixing part 22 is extended from a side edge of the base 21. Here uses, but not limited to, two fixing parts 22 as an example. The fixing part 22 includes a rod part 221, and one end of the rod part 221 is bent with a fastening piece 222 perpendicular to the rod part 221, and the fastening piece 222 is assembled in one of the fixing holes 13. Two latches 23 are respectively arranged on each of the two edges of the base 21, and the two latches 23 are perpendicular to the base 21, and the two latches 23 are arranged in the accommodating spaces 15. Each of the two latches 23 includes an arm part 231, and the front end of the arm part 231 includes a hook part 232 for hooking on the main connector. In the drawings of the present disclosure, the latch mechanism 2 is made of a metal material.

The release mechanism 3 is assembled between the two position limiting parts 14, and the release mechanism 3 is arranged on the latch mechanism 2. The release mechanism 3 includes a handle 31, and the front end of the handle 31 is extended with a protruding part 32. A blocking part 33 is arranged at the front end of the protruding part 32, and one side of the blocking part 33 includes a protruding wall 331. The cross section of the protruding part 32 is of arched shape or inverted-U shape. The bottom of the protruding part 32 is a concave bottom 321. The concave bottom 321 straddles over the base 21 of the latch mechanism 2. The concave bottom 321 includes an inclined surface 322 corresponding to a side edge of the base 21. When the release mechanism 3 is being pulled, the inclined surface 322 of the concave bottom 321 presses the side edge of the base 21, to make the base 21 sink. The two latches 23 on the two edges of the base 21 also sink and move simultaneously in the accommodating spaces 15 to release the buckling state with the main connector. Further, a through hole 34 is arranged on the protruding part 32. The through hole 34 is used for the pressing mechanism 45 on the cover 4 to pass to contact the base 21 of the latch mechanism 2.

The cover 4 is assembled on the foundation 1. Two edges of the cover 4 are bent with the two lugs 41 that are symmetrical to each other, and each lug 41 includes at least one engaging hole 411. The engaging holes 41 are engaged with the bumps 16 on both sides of the foundation 1. The inner surface of the cover 4 includes a front flange 42 and a rear flange 43. The front flange 42 and the rear flange 43 both have a notch 421, 431 corresponding to each other, and the protruding wall 331 and the handle 31 on the front end of the blocking part 33 of the release mechanism 3 are positioned by the two notches 421, 431, so that the protruding part 32 of the release mechanism 3 is located between the two notches 421, 431. An opening 44 is arranged between the front flange 42 and the rear flange 43. The pressing mechanism 45 is located on the opening 44 corresponding to the through hole 34 and integrally connected with the cover 4. When the pressing mechanism 45 is pressed, the pressing mechanism 45 presses the base 21 of the latch mechanism 2 though the through hole 34. At least one buckling part 46 and at least one fastening block 47 are disposed between the front flange 42 and the rear flange 43. When the cover 4 is assembled with the foundation 1, the buckling part 46 is assembled in the assembly hole 12, and the fastening blocks 16 are fastened in the fixing holes 13 to fasten the fastening piece 222 of the latch mechanism 2, so that the latch mechanism 2 is not easily detached or released, and the cover body 4 is firmly assembled on the foundation 1 at the same time. The two edges of the cover 4 include two perforations 48 symmetrical to each other. The hooks 232 of the two latches 23 may pass through the two through holes 48 to buckle and assemble with the main connector. In the drawings of the present disclosure, the pressing mechanism 45 is an elastic sheet.

Figure 2:
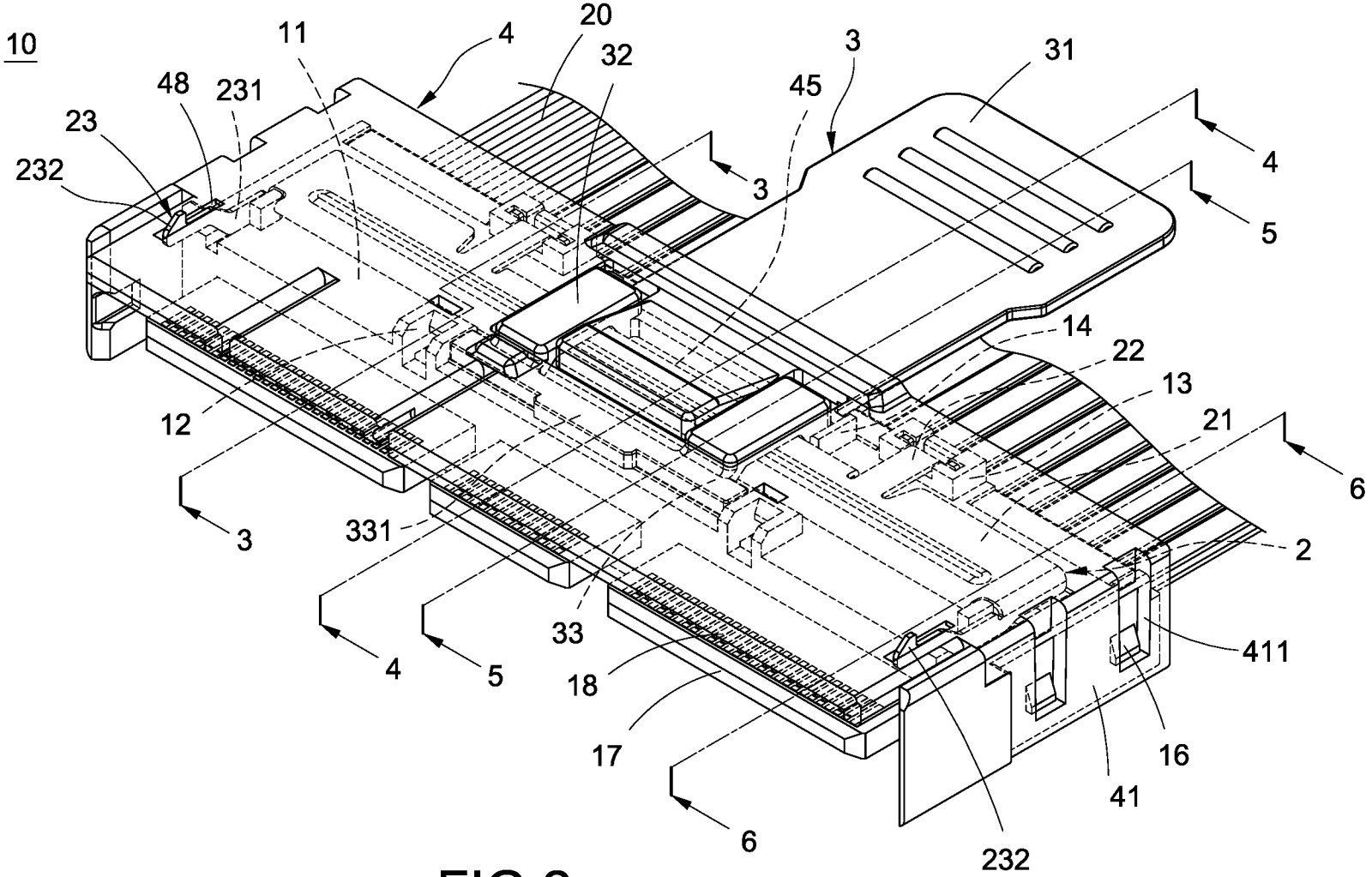
FIG. 2 is a schematic diagram of the three-dimensional assembly of the connector of the present disclosure.
Figure 3:
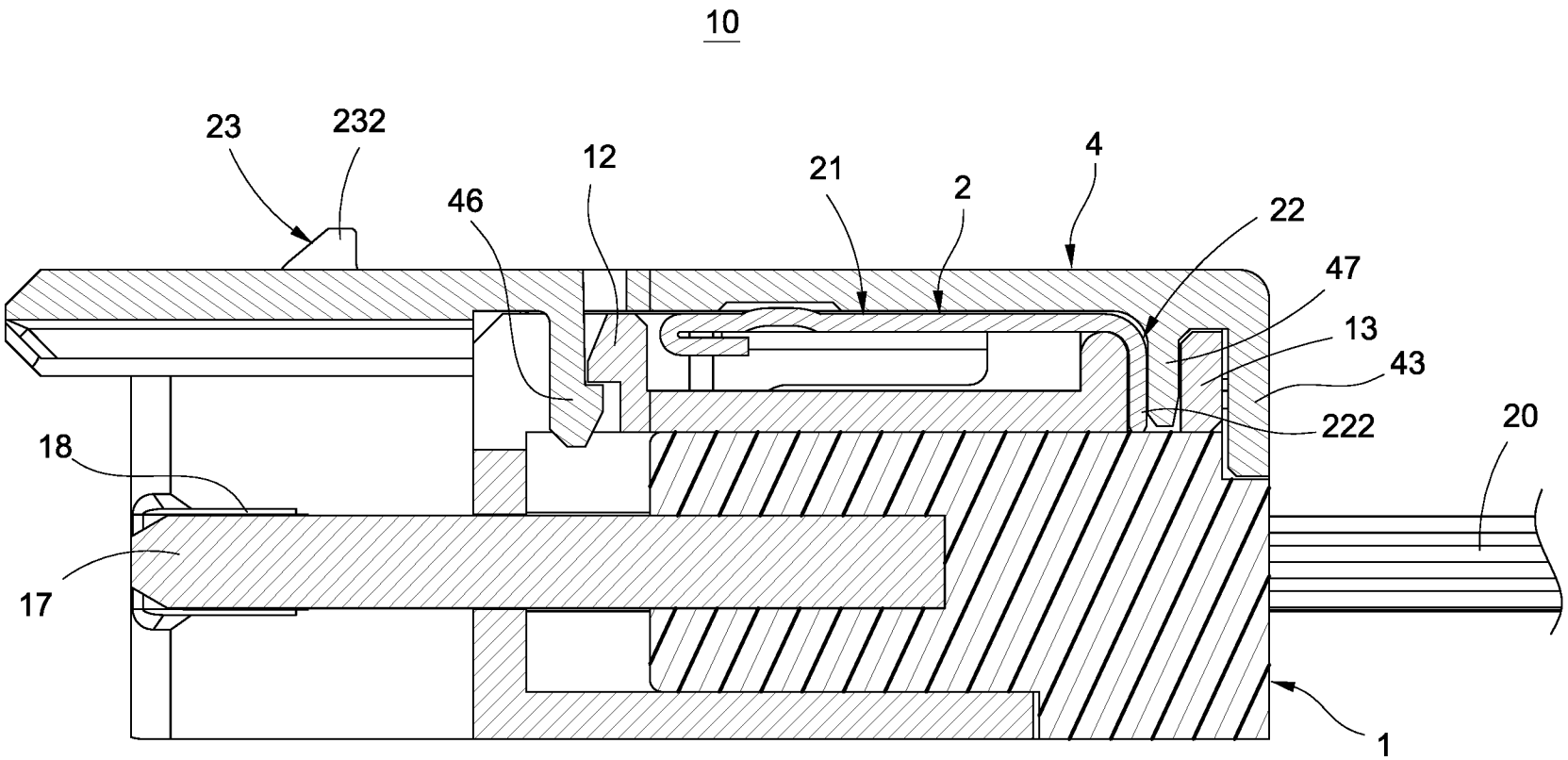
FIG. 3 is a schematic cross-sectional view of FIG. 2 at position 3-3.
Figure 4:
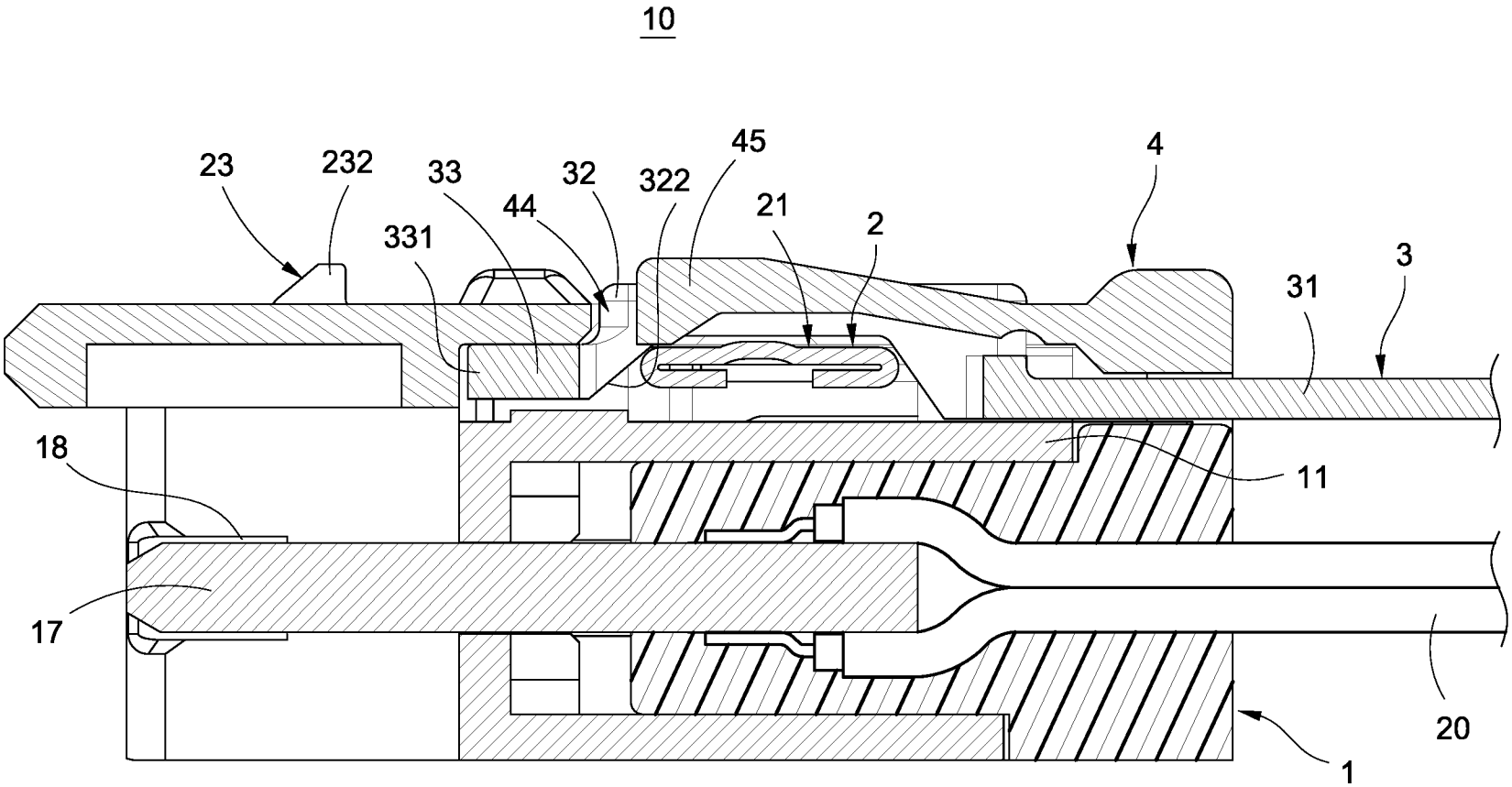
FIG. 4 is a schematic cross-sectional view of FIG. 2 at position 4-4.
Figure 6:
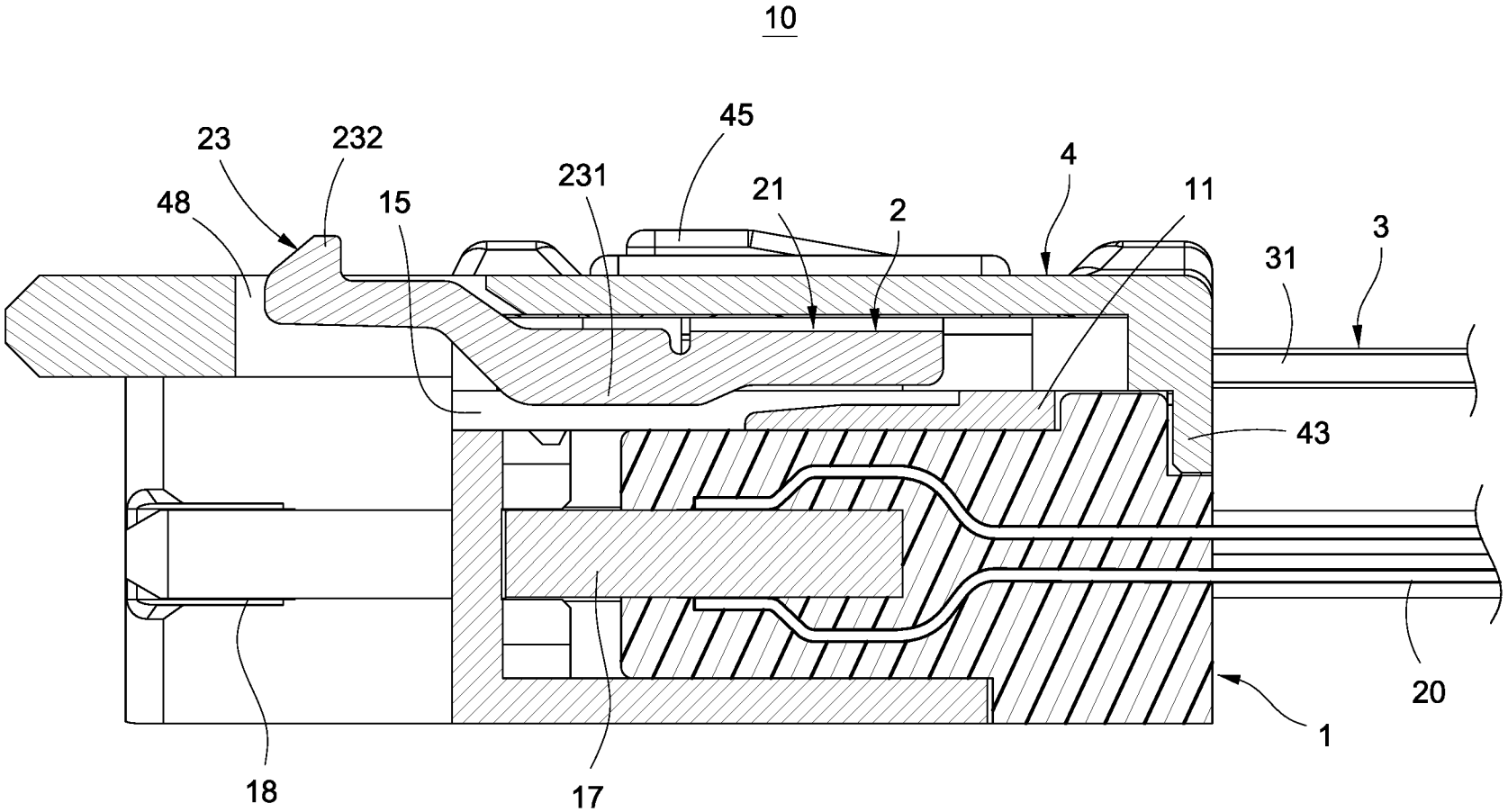
FIG. 6 is a schematic cross-sectional view of FIG. 2 at position 6-6.
Figure 7:
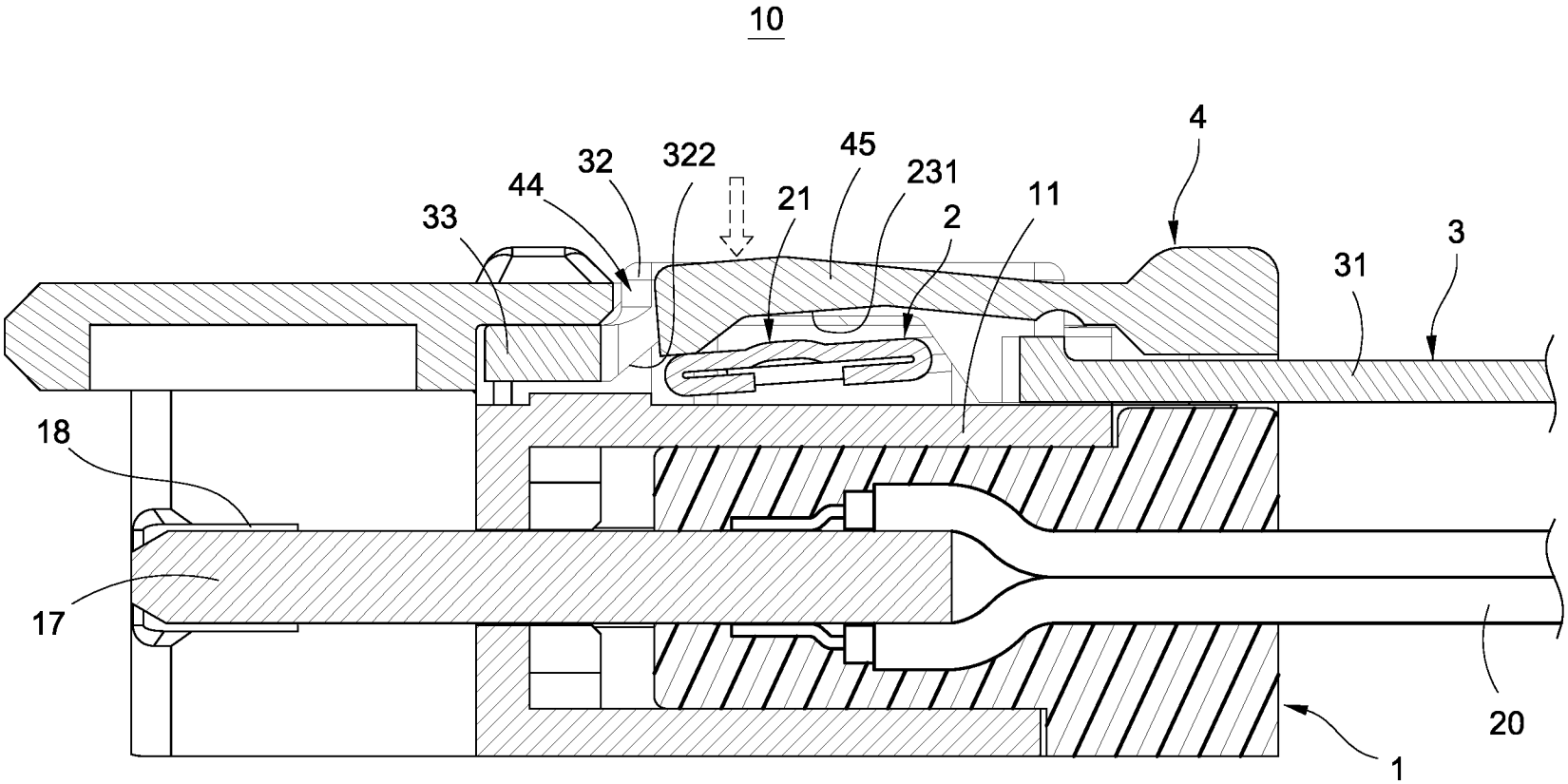
FIG. 7 is a schematic diagram of the action of FIG. 4.
Figure 8:
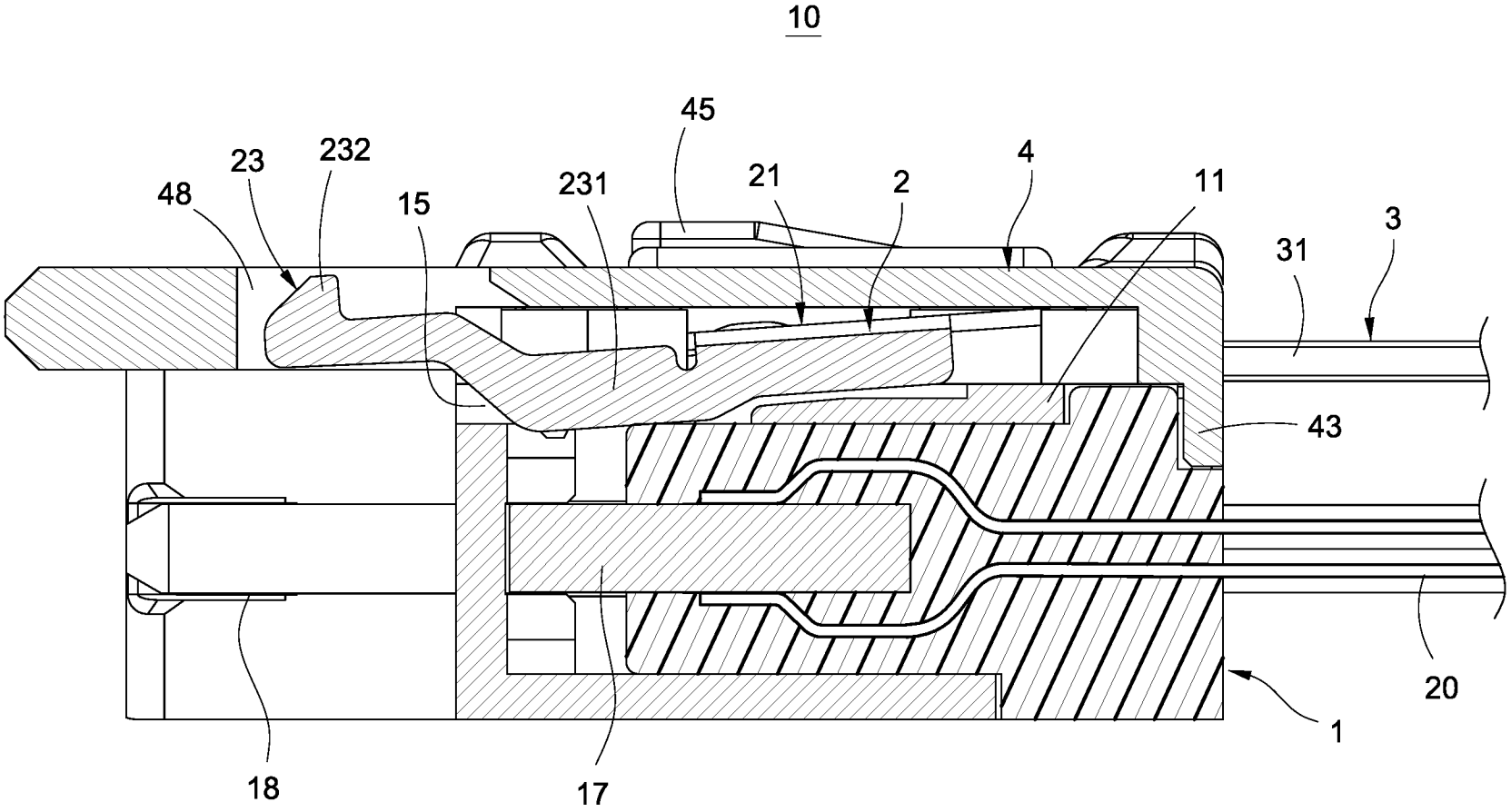
FIG. 8 is a schematic diagram of the action of FIG. 6.

Please refer to FIGS. 4, 6, 7, and 8. FIG. 4 is a schematic cross-sectional view of FIG. 2 at position 4-4. FIG. 6 is a schematic cross-sectional view of FIG. 2 at position 6-6. FIG. 7 is a schematic diagram of the action of FIG. 4. FIG. 8 is a schematic diagram of the action of FIG. 6.

As shown in the FIGS., after the foundation 1, the latch mechanism 2, the release mechanism 3, and the cover 4 of the connector 10 of the present disclosure are assembled in sequence, the connector 10 is electrically connected to the main connector (not shown). When the connector 10 needs to be detached, the pressing mechanism 45 on the cover 4 may be pressed down to the base 21 of the latch mechanism 2 to make the base 21 sink. At the same time, the two latches 23 sink in the accommodating space 15, so that the two latches 23 and the main connector are released from the locked state. After the connector 10 and the main connector are moved in different directions, the connector 10 is detached from the main connector.

Figure 5:
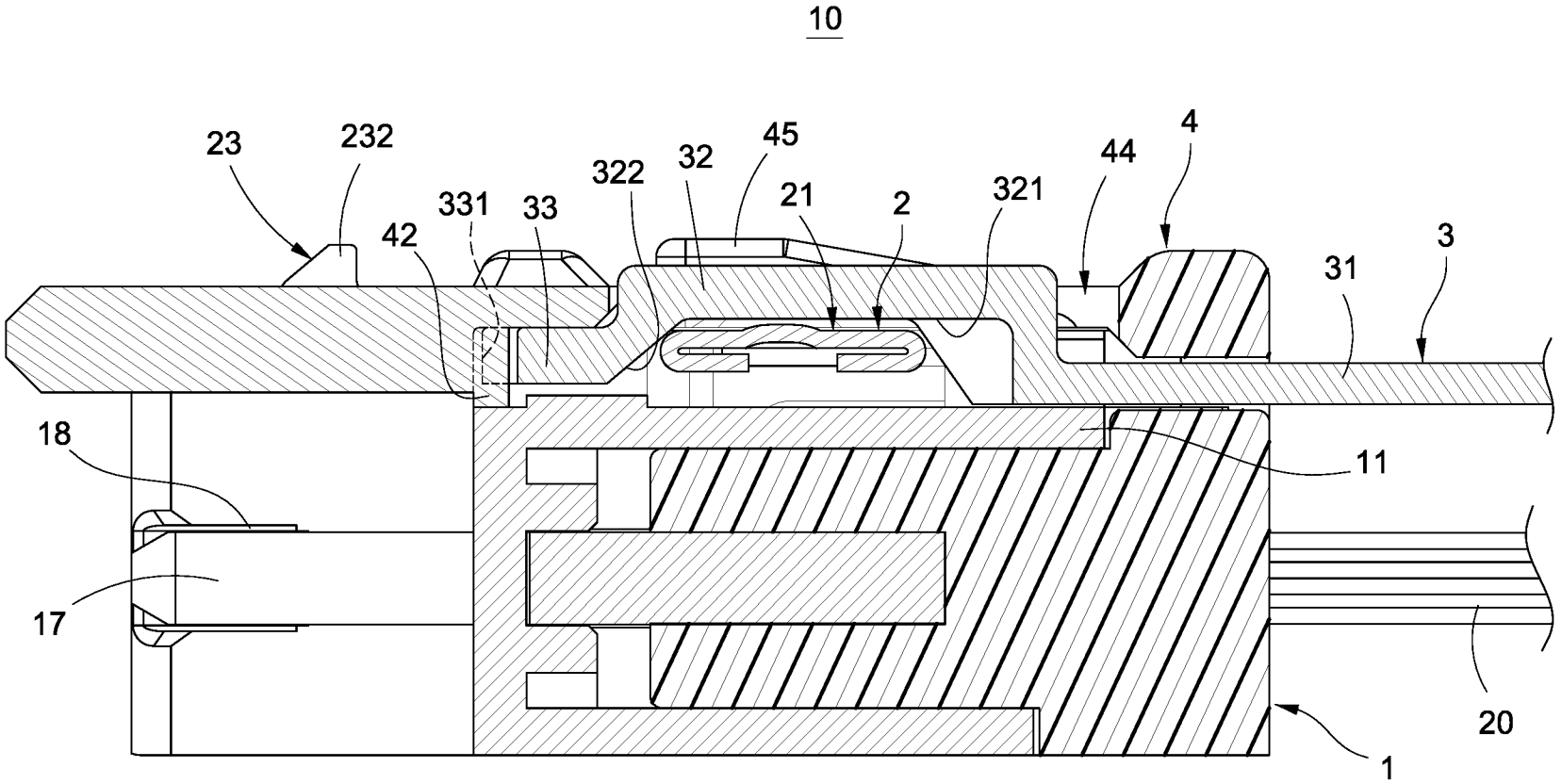
FIG. 5 is a schematic cross-sectional view of FIG. 2 at position 5-5.
Figure 9:
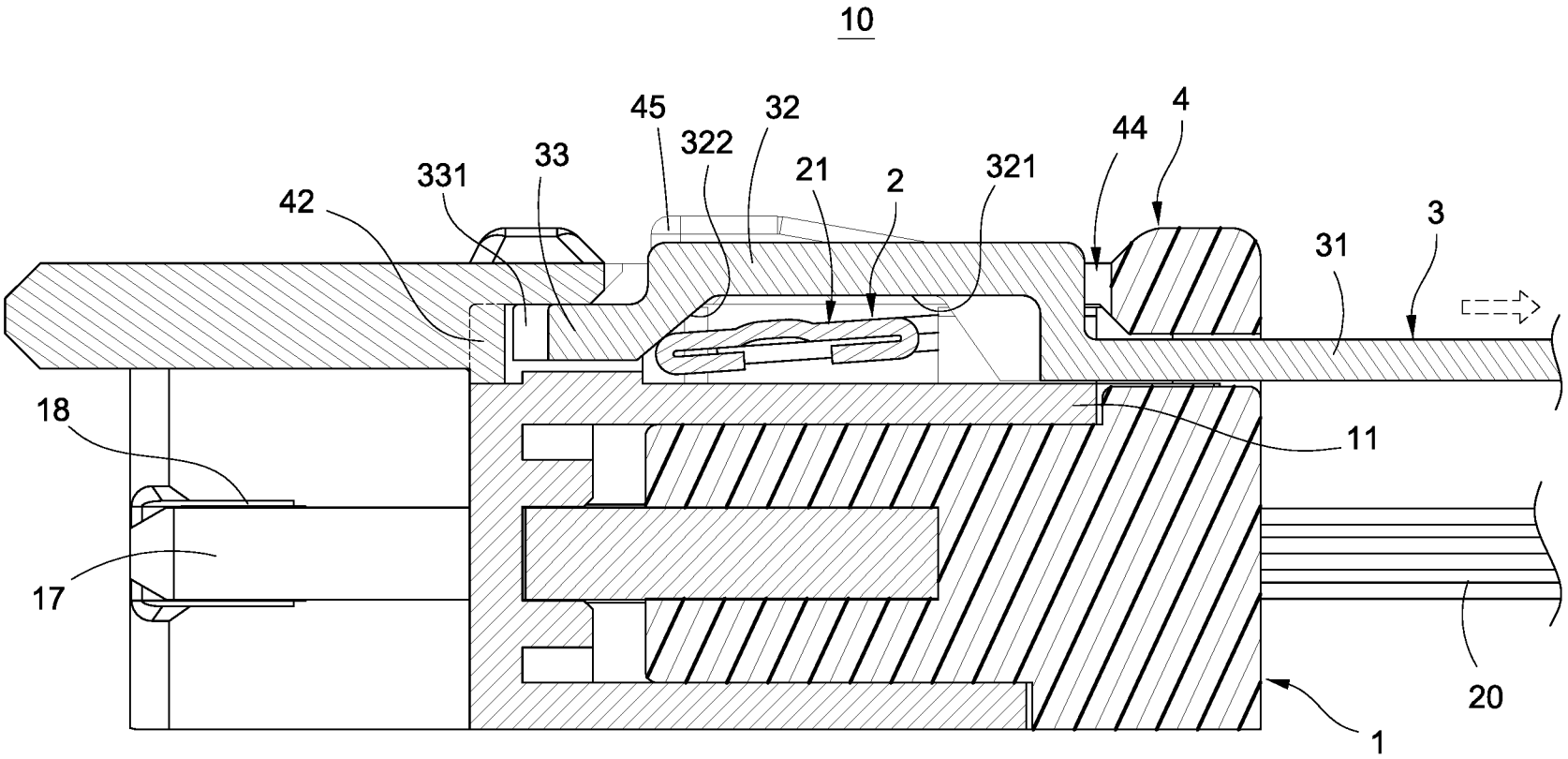
FIG. 9 is a schematic diagram of the action of FIG. 5.

Please refer to FIGS. 5, and 9. FIG. 5 is a schematic cross-sectional view of FIG. 2 at position 5-5. FIG. 9 is a schematic diagram of the action of FIG. 5.

As shown in the FIGS., after the connector 10 is electrically connected to the main connector (not shown), when the connector 10 needs to be unplugged, and the pressing mechanism 45 is blocked by other objects and unable to be pressed, the handle 31 of the release mechanism 3 may be pulled. When the release mechanism 3 is being pulled, the inclined surface 322 on the concave bottom 321 of the protruding part 32 abuts against the side edge of the base 21, and make the base 21 sink. At the same time, the two latches 23 on the two edges of the base 21 also sink and move simultaneously in the accommodating space 15 to release the buckling state with the main connector. After the connector 10 and the main connector are moved in different directions, the connector 10 is detached from the main connector.

The technical contents are only some embodiments of the present disclosure, and is not used to limit the scope of the present disclosure. Any modification of the structure, the change of the proportional relationship, or the adjustment of the size should be within the scope of the technical contents disclosed by the present disclosure without affecting the effects and the achievable effects of the present disclosure.

What is claimed is:

1. A connector with a pressing mechanism, and the connector comprising:

a foundation, comprising a top surface, and a front side of the top surface comprising at least one assembly hole, and a rear side of the top surface comprising at least one fixing hole, wherein position limiting part is arranged between the assembly holes, and arranged between the fixing holes, and two accommodating spaces symmetrical to each other are respectively arranged on two edges of the top surface;

a latch mechanism, assembled on the top surface, and comprising a base in a manner of an elastic sheet, wherein at least one fixing part fixed to the fixing hole is extended from a rear side edge of the base, two latches are respectively arranged on each of two edges of the base, and the two latches are perpendicular to the base and located in the accommodating spaces;

a release mechanism, assembled between the two position limiting parts, and arranged above the latch mechanism, wherein the release mechanism comprises a handle, and a front end of the handle is extended with a protruding part, and the protruding part comprises a concave bottom, the concave bottom straddles over the base, and the concave bottom comprises an inclined surface corresponding to a front side edge of the base, and the protruding part comprises a through hole; and a cover, assembled on the foundation, and comprising an opening, and the pressing mechanism integrally connected with the cover and located in the opening corresponding to the through hole, wherein the cover comprises at least one buckling part and at least one fastening block, and the buckling part is assembled in the assembly hole, and the fastening block is fastened in the fixing hole to fasten the fixing part of the latch mechanism.

2. The connector in claim 1, wherein the accommodating space is in a manner of a slit.

3. The connector in claim 1, wherein the foundation comprises at least one bump in a manner of a barb respectively disposed on two sides thereof.

4. The connector in claim 3, wherein the cover comprises two lugs bent from two edges thereof and symmetrical to each other, and each lug comprises at least one engaging hole, and the engaging hole is engaged with the bump on each side of the foundation.

5. The connector in claim 1, wherein a blocking part is arranged on a front end of the protruding part, and the blocking part comprises a protruding wall disposed on one side thereof.

6. The connector in claim 5, wherein the cover comprises a front flange and a rear flange disposed on an inner surface thereof, the front flange and the rear flange respectively have a notch corresponding to each other, and the protruding wall and the handle on the front end of the blocking part of the release mechanism are positioned by the two notches, the protruding part of the release mechanism is located between the two notches.

7. The connector in claim 6, wherein the opening, the buckling part, and the fastening block are arranged between the front flange and the rear flange.

8. The connector in claim 1, wherein the pressing mechanism comprises an elastic sheet.

9. The connector in claim 1, wherein a cross section of the protruding part is of an arched shape or an inverted-U shape.

10. The connector in claim 1, wherein the fixing part comprises a rod part, and the rod part comprises a fastening piece bent from one end thereof, and the fastening piece is perpendicular to the rod part, and the fastening piece is assembled in the fixing hole.

11. The connector in claim 1, wherein each of the two latches comprises an arm part, and the arm part comprises a hook part disposed on a front end thereof to hook on a main connector.

12. The connector in claim 1, wherein the foundation comprises at least one tongue disposed inside, and the tongue is extended outside the foundation and comprises a plurality of conductive terminals disposed thereon, and the conductive terminals are electrically connected with a cable.

13. The connector in claim 1, wherein the cover comprises two perforations respectively disposed on two edges thereof, and the two perforations are symmetrical to each other, and the two latches pass through the two perforations respectively.

14. The connector in claim 1, wherein the latch mechanism is made of a metal material.

* * * * *